US005511507A

United States Patent [19]

Allen

[11] Patent Number: 5,511,507

[45] Date of Patent: Apr. 30, 1996

[54] KAYAK COCKPIT COVER - WITH INTERCHANGEABLE SPRAY SKIRT WAISTBAND, DRY TOP, AND DRY TOP WITH INTERNAL P.F.D.

[76] Inventor: Jeff T. Allen, P.O. Box 1431, Kapaau, Hi. 96755

[21] Appl. No.: 338,398

[22] Filed: Nov. 14, 1994

[51] Int. Cl.[6] ..... B63B 35/00

[52] U.S. Cl. ..... 114/347

[58] Field of Search ..... 114/347, 361, 114/364, 345; 440/38; 403/5; 256/212

[56] References Cited

U.S. PATENT DOCUMENTS

| | | | |
|---|---|---|---|
| 4,583,480 | 4/1986 | Hamilton | 114/347 |
| 5,017,021 | 5/1991 | Simonsen | 383/63 |
| 5,192,135 | 3/1993 | Woods | 383/63 |
| 5,248,201 | 9/1993 | Kettner | 383/63 |
| 5,331,915 | 7/1994 | Snyder | 114/347 |
| 5,343,824 | 9/1994 | Floyd | 114/361 |

*Primary Examiner*—Stephen Avila

[57] ABSTRACT

A cockpit cover (15) with interchangeable spray skirt waistband (41), drytop (60), and drytop with internal P.F.D. (70) is disclosed for covering a cockpit opening (19) of a kayak (16). The cockpit cover (15) includes a fabric portion (40) for spanning the cockpit opening (19), which has an elastic coaming seal (20) unitarily cast around it's outer perimeter in a one step manufacturing process for retaining the cover about the rim, or coaming (18), and to ensure a water tight direct pressure seal. The coaming seal (20) is cast to fit the coaming (18) and is unaffected by the depth of the notch (44) under the coaming (18). The coaming seal (20) includes an end (22), a curved portion (23), and a cast union (24) where the coaming seal (20) is cast to the fabric portion of the cockpit cover (40). A rigid cockpit cover pull handle (21) is unitarily cast into the coaming seal (20) in two places, which when pulled, removes a large section of the coaming seal (20) causing the entire seal (20) to pop off to allow the boater to exit the boat quickly and easily. A female reclosable profile strip (61*b*) is attached around a circular opening in the fabric portion of the cockpit cover (40) so as to effect a water tight seal when mated with a male reclosable profile strip (61*a*) which is attached around the bottom of a spray skirt waistband (41), the dry top (60), or the dry top with internal P.F.D. (70). A reclosable profile seal release handle (28) is connected to the male profile strip (61*a*) to facilitate separation of the two profile strips (61*a* & 61*b*). The dry top (60) has adjustable short sleeve cuff seals (62) to allow any boater a good fit, an adjustable waistband seal (67) on the bottom, and also employs the use of adjustable suspenders (64) which are attached to the inside of the dry top (60) to support the slack material in the body of the dry top (60) and to prevent formation of voids or pockets that trap water. The dry top with internal P.F.D. (70) utilizes P.F.D. sections (72) ergonomically arranged and bonded to the inside of the dry top (70) thereby gaining insulation value from the P.F.D., and eliminating the voids associated with current external P.F.D.s.

3 Claims, 3 Drawing Sheets

KAYAK COCKPIT COVER - WITH INTERCHANGEABLE SPRAY SKIRT WAISTBAND, DRY TOP, AND DRY TOP WITH INTERNAL P.F.D.

BACKGROUND—FIELD OF INVENTION

The present invention relates generally to spray skirts, dry tops, and Personal Floatation Devices (herein referred to as P.F.D.'s), for use with kayaks, more particularly, to a cockpit cover with interchangeable spray skirt waistband, dry top, and dry top with internal P.F.D.

BACKGROUND—DESCRIPTION OF PRIOR ART

Kayaks are susceptible to being turned over in use and it is desirable to be able to return the kayak to an upright position while the boater remains seated. When used under white water conditions, entry of water into the hull interior through the cockpit opening is highly likely. For the above reasons, a cover which will fit about the boater and the cockpit opening to seal effectively against the entry of water is a problem to which considerable attention need be given. In case of emergency, the boater must be able to remove the cockpit cover quickly and easily without failure so that he or she may escape the kayak or boat, or alternatively be able to quickly and easily release from the cockpit cover in the event the cockpit cover becomes pinned to the kayak cockpit.

The above mentioned problems have become increasingly pronounced as a growing number of boaters are choosing to enter more severe white water conditions. In addition, since most rivers and ocean kayaking areas are cold water, it is desirable for the boater to wear a waterproof garment, hereafter referred to as a dry top, to protect the boater from the cold water. It is also desirable and usually required that the boater wear a properly fitted P.F.D. for safety.

Considerable attention should also be given to produce the safest, most comfortable and competitive combinations of the above mentioned items at a reasonable cost.

The perimeter of prior art sprayskirts is made by gathering the perimeter edge of the cockpit cover fabric. Then, a shorter length of elastic retaining band is glued or sewn to the perimeter edge of the fabric. This prior an configuration suffers from a number of disadvantages:

A) The prior an manufacturing process of gathering the perimeter edge of the cockpit cover fabric, then gluing or sewing a shorter length of elastic retaining band to it requires a slow and difficult multi-step process. This process also produces a contorted looking cockpit cover which is visually unappealing when it is not stretched over the cockpit.

B) The prior an utilizes either a soft nylon strap loop or the loose ends of an elastic retaining shock cord as the spray skirt pull handle. Both types of handles are prone to being accidentally entrapped under the cockpit cover when it is stretched over the cockpit coaming, resulting in the boater having no means to pull his or her spray skirt in case of emergency. This can produce a life threatening situation particularly with the current tight fitting spray skirts. Even if the boater keeps the spray skin handle out from under the spray skin, it can be relatively difficult to grip it in an emergency because the water can force the handle into the notch under the cockpit coaming.

The prior an has utilized nylon, nylon covered neoprene, rubber rand, or some combination there of. Nylon and nylon covered neoprene produce a poor water seal. U.S. Pat. No. 4,583,480 to Hamilton(Perception)1986 proposed a hollow elastic band which produces a fair seal. However, the sealing pressure and effectiveness of this hollow elastic band is further limited by the prior an spray skin configuration.

C) The elastic band's sealing pressure and effectiveness is reduced by the opposite force of the cockpit cover fabric, which pulls against the elastic band, thus reducing pressure between the elastic band and the notch under the cockpit coaming. This problem is compounded by the significant variance in depth from the coaming to the notch in various current kayak designs. Also, this depth often varies around the perimeter of a given cockpit.

D) In an effort to overcome the poor sealing capacity of the prior art configuration, it has been proposed that the elastic band be tighter and/or stronger. U.S. Pat. No. 4,583,480 to Hamilton (Perception) 1986, proposed an auxiliary tensioning member for increasing the tension of the elastic retaining band. These modifications have resulted in spray-skirts which are difficult to stretch over the cockpit coaming and difficult to remove, and can be unsafe for the boater who must be able to quickly and easily remove the spray skirt in an emergency.

Typically, the spray skirt, dry top, and P.F.D. are only available as separate items. Combining these three items warrants considerable attention because utilizing them as separate pieces has several disadvantages.

E) The spray skirt fitted opening or waistband seals the spray skirt to the boater's torso (chest) or more commonly to the boater's dry top (not to the boater's waist as the name implies). The irregular shape of the boater's torso, combined with the constant articulating movements involved in kayaking, result in a seal between the waistband and the boater/dry top which is poor at best. Additionally, to effect even a marginal seal the spray skirt waistband must be tight about the boater's torso which is uncomfortable and limits the depth of the boater's breathing, thereby increasing boater fatigue and vulnerability to mishap. Typical dry tops, having an inner and outer skirt to encase the spray skirt waistband, perpetuate this problem by limiting the elastic stretch of the waistband, and also add excessive material and subsequent cost.

It is therefor desirable to produce a cockpit cover with an attached dry top which is safe, watertight, and non-restrictive to the boater's movements and breathing (for use with pre-existing P.F.D.s).

A one piece dry top-spray skirt has been proposed and manufactured by Mountain Surf in Friendsville, Md. It consists of a dry top (without the inner skirt) sewn onto a shortened waistband of a prior art spray skirt, having all of the above mentioned disadvantages of prior art spray skirts. This configuration has additional disadvantages:

F) Because this dry top is sewn to the spray skin, a serious boater entrapment is likely if the kayak becomes pinned under water with the spray skin pinched onto the cockpit coaming preventing the boater's escape.

G) There is no means for sealing the bottom of the Mountain Surf dry top-spray skin to the boater. If the boater executes a wet exit, the dry top portion immediately becomes flooded.

H) The Mountain Surf spray skin waistband is larger than the boater's torso to enable the boater to put it on over his or her head and shoulders. Therefore, the spray skin waistband and dry top are loose about the waist of the boater. The force of the white water can push the loose fabric down below the cockpit cover forming a water pocket. This condition pulls the dry top down on the boater's shoulders, impairing the boater's freedom of movement.

I) The boater cannot change the specific combination of the Mountain Surf dry top and spray skin for different boating conditions because this dry top and spray skin are permanently sewn together. Also, if the dry top or spray skirt become destroyed or wear out, the garment must be returned to the factory to replace the defective pan.

It is therefore desirable to utilize a reclosable seal between the dry top and spray skin.

J) Profile seals have been proposed for the purpose of resealing bag enclosures, for example, U.S. Pat. No. 5,248,201 to Kettner(1993), U.S. Pat. No. 5,192,135 to Woods(1993), U.S. Pat. No. 5,017,021 to Simonsen(1991). However, these profile seals will not adequately handle the lateral shear forces encountered in my application.

K) Prior art short sleeve dry tops have no means to adjust the tension of the arm (biceps) cuff seal, which results in only a limited number of boaters enjoying a good cuff seal and correct fit within a given dry top size.

L) The prior an dry top and P.F.D. form large cavities or voids which fill with water while the boater is overturned. This adds weight to the boater's torso, making it slower and more difficult to roll back upright. The cavities or voids referred to occur between the spray skin waistband and the outer skirt of the dry top, and particularly between dry top and P.F.D. These cavities drain quickly once upright, however they hold considerable amounts of water during the roll up maneuver, and render the P.F.D. relatively ineffective as a thick layer of insulation for the boater's torso.

OBJECTS AND ADVANTAGES

Accordingly, several objects and advantages of the present invention are:

A) To provide a kayak cockpit cover with attached spray skirt waistband according to the first embodiment for covering the cockpit opening of a kayak which has an elastic coaming seal and a pull handle unitarily cast onto a flat cockpit cover in a single step manufacturing process, thereby reducing manufacturing costs, and producing a cockpit cover having a neat and uniform appearance.

B) To provide a cockpit cover having a pull handle which is rigid and securely cast into the coaming seal in two places, which cannot become accidentally entrapped under the cockpit cover or forced into the notch under the cockpit coaming by the force of the water, which retains it's shape and position as an immediately accessible open pull handle, and which when pulled, initiates the removal of a larger section of the coaming seal thereby facilitating a very quick removal of the cockpit cover without failure.

C) To provide a cockpit cover having an elastic unitarily cast coaming seal which produces a superior direct pressure water seal between coaming seal and cockpit coaming, which is unaffected by the depth from the coaming to the notch.

D) To provide a coaming seal which effects a superior water seal under a variety of water roughness conditions without being extremely tight or necessitating an auxiliary tensioning member, and which enables the cockpit coaming to be fitted about the cockpit and removed quickly and easily.

E) To provide a cockpit cover having a detachable waistband with a waistband seal according to the first embodiment of the present invention, which produces a superior water resistant seal between the waistband and the boater or dry top for use with pre-existing dry tops and P.F.D.s or in certain warm and/or flat water conditions. To optionally provide an attachable dry top according to the second embodiment, utilizing a reclosable profile seal to effect a water tight seal between the cockpit cover and the dry top, which has an adjustable elastic waistband attached to the dry top and fitted about the boater's waist, thereby sealing the bottom of the dry top and eliminating the spray skirt waistband and subsequent restriction to the boater's torso and breathing, and which requires substantially less material and labor to make, thereby reducing manufacturing cost.

F) To provide a cockpit cover which is attached to a dry top utilizing a releasable fastener such as a reclosable profile seal, which can be quickly and easily separated allowing the boater to escape the kayak in an emergency where the cockpit cover is pinned to the kayak.

G) To provide a cockpit cover which is attached to a dry top, which has an adjustable elastic waistband attached to the dry top and fitted about the boater's waist thereby sealing the bottom of the dry top against the entry of water in the event of a wet exit.

H) To provide a cockpit cover which is attached to a dry top, which has an adjustable internal suspension device such as suspenders to support the dry top, thereby preventing water pockets from forming below the cockpit cover and thereby allowing the shoulder section of the dry top to remain loose.

I) To provide a cockpit cover which is attached to a dry top utilizing a reclosable profile seal which can be quickly and easily separated, which enables the boater to easily replace either the dry top, spray skirt waistband, or cockpit cover in the event one gets damaged or for different boating conditions.

J) To provide a cockpit cover which is attached to a dry top or spray skin waistband utilizing a reclosable profile seal, which will effect a water tight seal while remaining unaffected by the lateral shear forces encountered in the present application.

K) To provide a cockpit cover which is attached to a dry top, which has adjustable elastic short sleeve cuff seals allowing the boater a greater level of comfort and fit.

L) To provide a cockpit cover with attached dry top and internal P.F.D. according to the third embodiment of the present invention, which is free of voids or cavities to trap water, which enables the boater to wear fewer layers of under clothing for insulation, which utilizes ergonomically segmented P.F.D. sections, and thereby allows greater freedom of movement, comfort, and safety to the boater, and which requires substantially less material and labor to make, thereby reducing manufacturing cost. Still further objects and advantages will become apparent from a consideration of the ensuing description and drawings.

Figure 1:
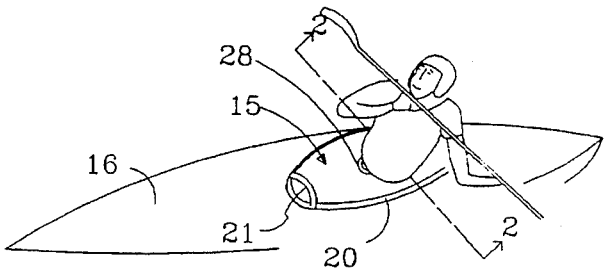
FIG 1 Shows a non-specific perspective view illustrating a kayak having a cockpit cover and boater for the purpose of illustrating the configurations of the three embodiments of the present invention.

REFERENCE NUMERALS IN DRAWINGS:

| | |
|---|---|
| 15 cockpit cover | 40 fabric portion of the cockpit cover |
| 16 kayak | 41 spray skirt waistband (first embodiment) |
| 17 rounded exterior hull | 42 waistband seal |
| 18 cockpit coaming | 44 notch under coaming |
| 19 cockpit opening | 45 top external section of coaming |
| 20 coaming seal | 46 top inside edge of coaming |
| 21 cockpit cover pull handle | 60 dry top with adjustable suspenders, short sleeve cuff seals, and waistband seal (second embodiment) |
| 22 end of coaming seal | 61a male reclosable profile strip |
| 23 curved portion of coaming seal | 61b female reclosable profile strip |
| 24 cast union of coaming seal and cockpit cover fabric | 62 adjustable short sleeve cuff seal |
| 25 perimetrical ribs | 64 adjustable suspenders |
| 26 dovetailed end of cockpit cover pull handle | 66 dry top waistband |
| 27 section of coaming seal enlarged around inserted cockpit cover pull handle | 67 adjustable waistband seal |
| 28 reclosable profile seal release handle | 70 dry top with internal P.F.D. (third embodiment) |
| 30 hook of male profile strip | 71 yoke section of suspenders for dry top with internal P.F.D. |
| 31 hook of female profile strip | 72 P.F.D. sections |
| 32 three point male sealing member | |
| 33 female socket block | |
| 34 socket | |

DESCRIPTION FIGS. 1, 2, 5, 7, 8, & 9

(first embodiment)

Figure 2:
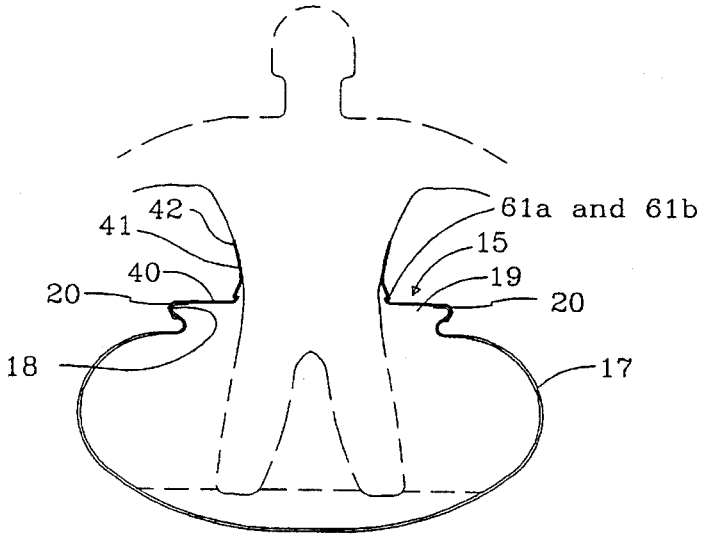
FIG. 2 Shows a sectional view taken generally along line 2—2 of FIG 1 depicting structural specifics of the first embodiment of this invention wherein a cockpit cover is attached to a spray skirt waistband (standard spray skirt configuration).

Referring now in more detail to the drawing FIGS. 1 (a nonspecific perspective view) and 2 (a sectional view taken along the line 2—2 of FIG. 1 ), a kayak (16) is illustrated which includes a rounded exterior hull (17). The boater is illustrated on his or her knees in FIG. 2 which would correspond to a "C-1" type kayak. In other types of kayaks the boater is seated. However, in either type of kayak, there is a cockpit opening (19) in which the boater either sits or kneels. The cockpit opening typically includes a raised rim having an outwardly extending lip or coaming (18) which over hangs a portion of the hull (17).

Figure 8:
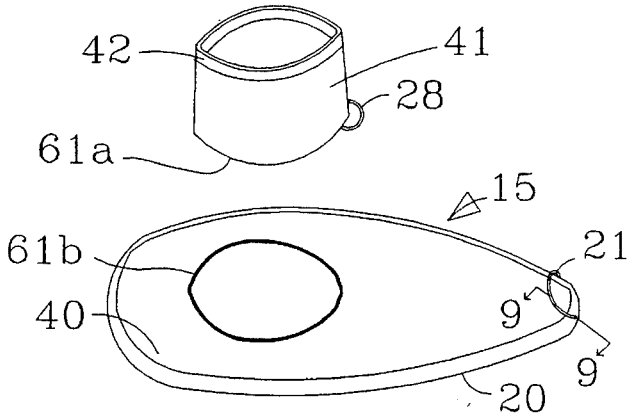
FIG. 8 Shows a perspective view of a spray skin waistband, disconnected and separated from the cockpit cover constructed according to the first embodiment of the present invention (standard spray skirt configuration).

As illustrated in FIG. 8 (perspective view of a waistband shown disconnected from a cockpit cover) a cockpit cover (15) has an elastic coaming seal (20) unitarily cast around it's outer perimeter. A fitted opening or waistband (41) is attached to the top of a circular opening in the cockpit cover (15) by means of a releasable fastener such as a reclosable profile seal (61*a* & 61*b*), and a waistband seal (42) is attached to the top of the waistband. An elongated gripping member or cockpit cover pull handle (21) is unitarily cast into the front of the coaming seal (20) in two places.

Figure 7:
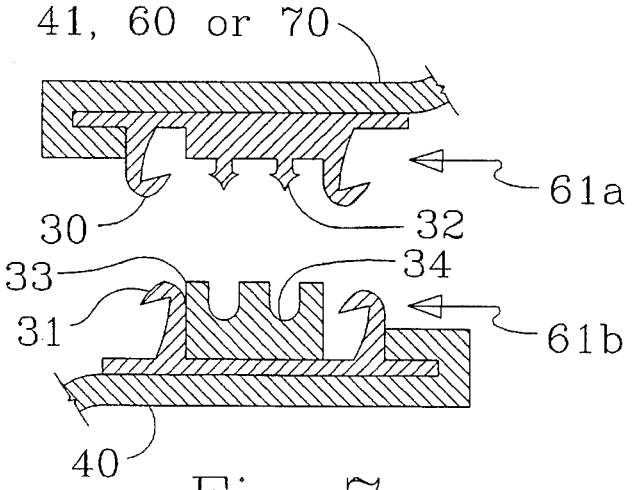
FIG. 7 Shows an enlarged sectional view of a reclosable profile seal for attaching and sealing the cockpit cover to a spray skin waistband, dry top, or dry top with internal P.F.D., constructed according to the present invention.

A female profile strip (61*b*) is attached around the top side of a circular opening in a fabric portion of the cockpit cover (40). The female strip (61*b*) has two hooks (31) oriented in the same direction and located at each side of a female socket block (33) co-extruded and attached, as illustrated in FIGS. 7 (enlarged sectional view of a reclosable profile seal) and 8. The hooks (31) and socket block (33) with two sockets (34) are made of an elastomer, preferably polyurethane in a hardness range of 70–90 Shore A durometer for the hooks, and 50 Shore A durometer for the female socket block. A male reclosable profile strip (61*a*) is attached about the inside edge of the bottom of the waistband (41). The male strip (61*a*) has two hooks (30) oriented in the same direction and located at each side of the two male members (32) having arrow-shaped distal ends of approximately triangular cross-section. The male strip (61*a*) is also extruded of polyurethane 70–90 Shore A durometer. Suitable materials are available from Oregon Polymer Systems of Hubbard, Oreg. Oregon Polymer Systems can also perform the extrusions.

Figure 5:
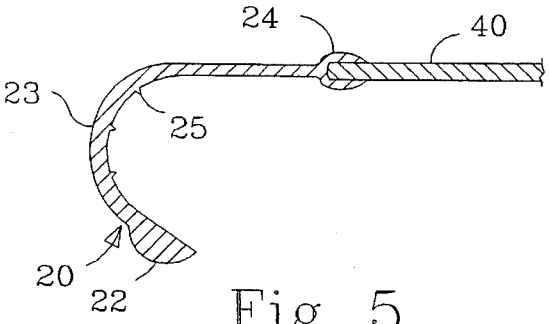
FIG. 5 Shows an enlarged sectional view of a cockpit coaming seal for retaining and sealing a cockpit cover fitted about the rim, or coaming of a kayak cockpit opening according to the present invention.

The cockpit cover (15), having a fiat portion which is typically made of a nylon coated neoprene material is referred to as the fabric portion of the cockpit cover (40) herein. The coaming seal (20) has a cast shape as a female mate to the male shape of tile cockpit coaming (18), both cross-sectionally and perimetrically, which retains this shape while off tile cockpit coaming (18), the coaming seal (20) has an end (22) on the bottom, a curved portion (23) in the middle, and a cast union (24) of the coaming seal (20) and the cockpit cover fabric (40) on top as illustrated in FIG. 5 (enlarged sectional view of a coaming seal). The inside of the curved portion (23) has ribs (25) raised from the surface of the coaming seal (20) extending around the coaming seal (20) within the curved portion (23) in the direction of the perimeter of the cockpit cover (15). The coaming seal (20) is made of a castable elastomer, preferably polyurethane, having physical properties of high tear and abrasion resistance, high elongation and elasticity, high tensile strength, low viscosity in its pre-cast liquid form, and excellent resistance to fresh and salt water. The polyurethane coaming seal (20) preferably has a hardness in the range of 35 to 50 Shore A durometer. A suitable polyurethane compound is available from Action Products, of Vancouver, Wash. Action Products also has the facility to do the injection molding or casting. Suitable molds can be produced by a competent mold maker such as B.C.I. Manufacturing, Inc., of Milwaukie, Oreg..

Figure 9:
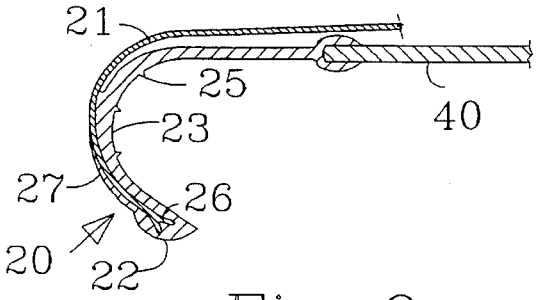
FIG. 9 Shows an enlarged sectional view taken along line 9—9 of FIG. 8 depicting an end of a spray skiff pull handle cast into the coaming seal according to the invention.

The pull handle (21) has it's ends (26) cut and dovetailed, and cast into an enlarged portion of the coaming seal (27) as illustrated in FIG. 9 (enlarged sectional view taken along line 9—9 of FIG. 8). The pull handle (21) is preferably of dense nylon webbing ¼"–⅜" wide, coated with a durable air-cure elastomer roughly 80–90 Shore A durometer, and allowed to cure in it's preferred shape before it is cast into the coaming seal (20). A suitable air-cure elastomer is also available from Action Products of Vancouver, Wash.. The pull handle (21) has a preferred shape and location as follows: starting at one dovetailed end (26) cast into the end of the coaming seal (22), cross-sectionally passing through half of the curved portion of the coaming seal (23) where it exits the coaming seal (20), thence passing just over the top of the balance of the coaming seal (20) as illustrated FIG. 9, where it makes a wide flattened curve just over the front portion of the cockpit cover (40) as illustrated FIG. 8, thence back into the coaming seal (20) in a reversed identical manner, such that the points of the insertion into the coaming seal (20) are roughly 4"–6" apart and centered over the front of the cockpit cover (15).

A reclosable profile seal release handle (28) is connected to the male profile strip (61*a*) at the front of the bottom of the spray skirt waistband (41) in two places, approximately 3–4 inches apart, making a loop as shown in FIGS. 1 and 8. The release handle (28) is made of the same webbing as the cockpit cover pull handle (21) with the same coating of elastomer to retain it's shape.

The waistband (41) is typically made of the same nylon coated neoprene material as the cockpit cover (15). The waistband seal (42) is preferably made of a thicker, higher quality neoprene having physical properties of high density, durability, high elongation, and elasticity and coated only on the exterior surface with high stretch nylon, leaving the internal surface as bare rubber. A suitable neoprene is available from Rubatex, of Bedford, Va., under the trade name G-23 1-N, 3/16" thickness, N-1-S #900 fabric.

OPERATION FIGS. 1, 2, & 6

(first embodiment)

The manner of using the cockpit cover (15) and attached spray skirt waistband (41) to prevent entry of water into the kayak (16) is similar to that for spray skins in present use. Namely, the cockpit cover (15) with attached spray skin waistband (41 ) which fits about the torso of the boater is provided for covering the cockpit opening (19), to prevent entry of water into the interior of the hull through the cockpit opening (19). First the boater pulls the spray skin waistband (41) with attached cockpit cover (15) up around his or her torso. Next, the boater sits, or kneels in the kayak (16), grasps the cockpit cover (15) by the elastic coaming seal (20), and stretches it over the kayak cockpit coaming (18) as illustrated in FIGS. 1 (perspective view), 2 (sectional view), and 6 (enlarged sectional view of coaming seal fitted about the kayak coaming). The coaming seal (20), having a female shape as a mate to the male cockpit coaming (18) when slack, fits about the cockpit coaming (18) easily and is thereby unaffected by the depth of the notch (44) under the cockpit coaming (18).

The cast coaming seal (20) can be made of a lower durometer, higher elasticity and elongation, and more durable material than prior art retaining bands. This material enables the cockpit cover (15) to be easily and quickly stretched over the cockpit coaming (18) or removed, while producing a superior water seal between coaming seal (20) and coaming (18) under a variety of white water conditions. The inside surface of the curved portion of the coaming seal (23) has raised ribs (25) to further improve the water seal between coaming seal (20) and coaming (18).

Figure 6:
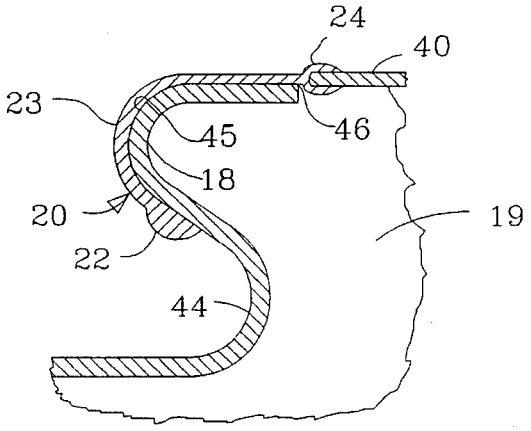
FIG. 6 Shows an enlarged sectional view illustrating the coaming seal constructed according to the present invention fitted about the coaming of a kayak cockpit.

As is shown in FIG. 6, the coaming seal (20), when fitted about the cockpit coaming (18) covers the exposed areas (45 & 46) of the coaming (18) and thereby extends the useful life of the cockpit cover (15) and reduces the possibility of damage and failure.

To remove the cockpit cover (15) from the cockpit coaming (18), the boater reaches forward and grips the cockpit cover pull handle (21) and gives it a quick jerk back towards himself or herself. This action removes a large section of coaming seal (20) from the front of the cockpit coaming (18) and causes the rest of the seal (20) to release immediately. The pull handle (21), being rigid and east into the coaming seal (20) in two places remains open and immediately accessible to the boater regardless of water roughness. By design, the handle (21) cannot become accidentally trapped under the cockpit cover (15) or forced into the notch (44) under the cockpit coaming (18).

The male profile strip (61*a*) and the female strip (61*b*) are mated together as in the above mentioned prior art profile seals. The female strip (61*b*) and the male strip (61*a*) are configured such that when correctly mated, or pushed together, the female hooks (31) interlock with the opposing male hooks (30). The male sealing members (32) being slightly wider than the sockets (34) of the female socket block (33), wedge into the lower durometer socket block (33) producing a water tight 3-point seal. This configuration is arranged to withstand relatively high uni-directional lateral shear forces while maintaining a water tight seal.

To separate the sprayskirt waist band (41) from the cockpit cover (15), the boater pulls the reclosable profile seal release handle (28) disengaging the exterior set of reclosable profile hooks, followed by the sealing members (32) from the sockets (34) and interior set of hooks nearly simultaneously in a peeling motion, and continuing lengthwise around the entire profile seal (61*a* & 61*b*) thereby effecting a quick and easy release of the entire profile seal (61*a* & 61*b*). This may be done for the following reasons; 1) to provide a secondary escape procedure in the event the cockpit cover (15) gets pinned to the kayak cockpit coaming (18); 2) to provide a means to interchange the spray skirt waistband (41) with the dry top (60) or with the dry top with internal P.F.D. (70) for various boating conditions; or 3) to replace any section which is damaged or worn out.

A waistband seal (42) is attached to the top of the waistband (41) which improves the water resistant seal between the spray skin waistband (41) and boater's torso or Prior An dry top.

DESCRIPTION FIG. 3

Figure 3:
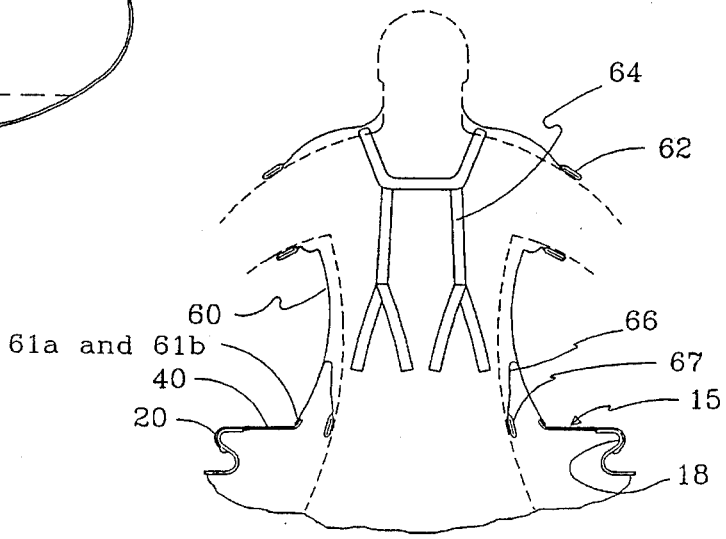
FIG. 3 Shows a sectional view taken generally along line 2—2 of FIG. 1 illustrating a second embodiment of the invention wherein a cockpit cover is attached to a dry top with adjustable suspenders.

Referring now in more detail to FIG. 3 ( a sectional view taken along line 2—2 of FIG. 1 illustrating a second embodiment of the present invention wherein a cockpit cover is attached to a dry top with adjustable suspenders). This embodiment uses the same cockpit cover (15) as in the first embodiment, however the spray skin waistband (41) is replaced with a dry top (60). The dry top (60) has a lower section made of a water proof material such as nylon covered neoprene, which is connected to the male profile strip (61*a*) at the bottom, and extends up to a seam, where the upper section of the dry top (60), a suspension device such as a set of adjustable suspenders (64), and a dry top waistband (66) are all connected. A reclosable profile seal release handle (28) (not shown in FIG. 3) is connected to the male profile strip (61*a*) on the dry top (60) in the same manner as the aforementioned spray skin waistband (41) (first embodiment). The dry top (60) has an upper section made of a water proof material, which is preferably breathable, such as Gore Tex® (a registered trademark of W. L.

Gore and Associates, Inc.). The suspension device or adjustable suspenders (64) are preferably made of a soft hollow nylon webbing with an adjustable buckle (not shown) on each of the webbing sections between the lower inverted V section and the yoke section. The suspenders (64) are similar on the back side (not shown). The dry top waistband (66) is made of an elastic water proof material such as high quality, high stretch nylon coated neoprene. An adjustable waistband seal (67) is connected to the bottom of the waistband (66). The adjustable waistband seal (67) is cuff shaped and made of an elastic water proof material such as high quality, high stretch nylon coated neoprene. The inside cuff band is made of nylon-one neoprene, with the exposed neoprene rubber against the boater. The waistband seal (67) encases an elastic strap. The elastic strap has one end secured at a point inside the front of the waistband seal (67) thence extending within the length of the waistband seal (67) where it exits through an exterior slot in the waistband seal (67)just before reaching it's secured point of origin where it runs through an adjustable buckle (not shown). The adjustable buckle is on the exterior of the waistband seal (67) and fastened through the seal (67) into the secured end of the elastic strap. An adjustable short sleeve cuff seal (62) is attached to each sleeve of the dry top (60). The short sleeve cuff seal (62) is made of the same material and in the same manner as the adjustable dry top waistband seal (67).

A suitable neoprene for the short sleeve cuff seals (62), waist band (66), and waistband seal (67) is available from Rubatex of Bedford, Va. under the trade name G-23 1-N coated with high stretch nylon fabric.

A latex neck seal is utilized to seal the dry top about the neck.

OPERATION FIG. 3—

(second embodiment)

The manner of using the dry top (60) with the attached cockpit cover (15) to protect the boater from the cold water and to prevent entry of water into the kayak (16) is as follows: The boater dons the dry top (60) with attached cockpit cover (15) over his or her head and shoulders in the same manner as with standard separate dry tops in present use. The boater can then adjust the waistband seal (67) and the short sleeve cuff seals (62) to obtain a proper fit. The boater then sits or kneels in the kayak (16) and can adjust the suspenders (64) so that the lower section of the dry top (60) is supported sufficiently to prevent water from pocketing around the bottom of the dry top (60), making sure that the yoke section of the suspenders (64) is properly centered over his or her shoulders to allow a complete range of movement without restriction.

The boater can then fit the cockpit cover (15) about the kayak coaming (18) as previously described in the first embodiment. The cockpit cover (15) is removed from the cockpit coaming (18) as previously described in the first embodiment. The dry top (60) is separated from the cockpit cover (15) by pulling the reclosable profile seal release handle (28) as previously described in the first embodiment for separating the waistband (41) form the cockpit cover (15).

DESCRIPTION FIG. 4—

(third embodiment)

Figure 4:
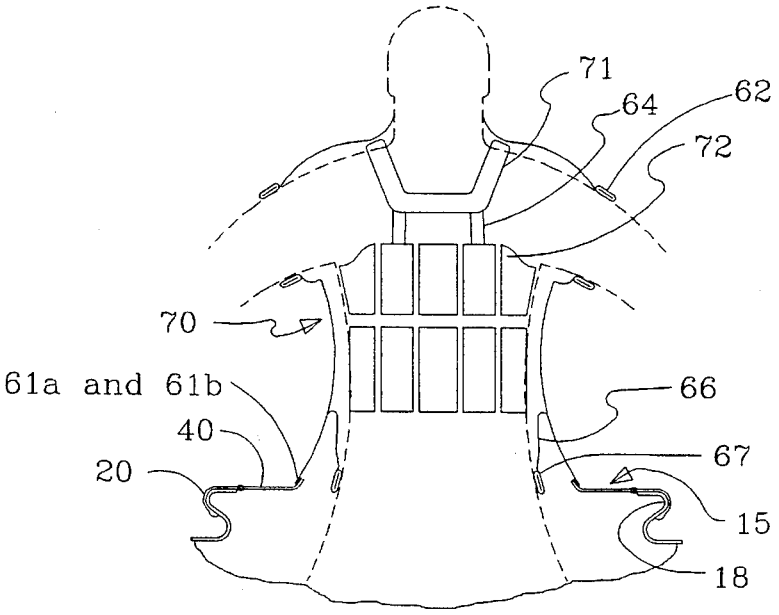
FIG. 4 Shows a sectional view taken generally along line 2—2 of FIG. 1 illustrating a third embodiment of the invention wherein a cockpit cover is attached to a dry top with adjustable suspenders and internal P.F.D.

Referring now in more detail to the drawing FIG. 4 (a sectional view taken along line 2—2 of FIG. 1 illustrating a third embodiment of the present invention wherein a cockpit cover is attached to a dry top with adjustable suspenders and internal P.F.D. ), the third embodiment of the present invention is the same as the second embodiment, with the exception of three additions. Firstly internal P.F.D. sections (72) are added to the dry top. The dry top with internal P.F.D. (70) has high quality pliable P.F.D. sections (72), ergonomically arranged and bonded to the inside of the upper portion of the dry top, being just above the seam where the dry top waistband (66) is attached. Secondly, the yoke section (71) of the suspenders (64) is made of soft hollow nylon webbing with an overlay of high quality pliable P.F.D. material attached to the outside of the webbing. And Thirdly, there are two sets of adjustable elastic cinch straps (not shown) attached to the outer sides of the dry top with internal P.F.D. (70). These cinch straps connect the top row of P.F.D. sections (72) in the front, to the top row of P.F.D. sections (72) in the back (not shown). The bottom row of P.F.D. sections (72) is connected in the same manner.

OPERATION FIG. 4—

(third embodiment)

The cockpit cover (15) with attached dry top and internal P.F.D. (70) is utilized in the same manner as the cockpit cover (15) with attached dry top (60), as previously described in the second embodiment, with the addition of elastic cinch straps (not shown) which the boater tightens or loosens to achieve a proper fit of the P.F.D.

CONCLUSION, RAMIFICATIONS, AND SCOPE

Accordingly, the reader will see that the kayak cockpit cover with interchangeable spray skirt waistband, dry top, and dry top with internal P.F.D. of this invention will provide the boater with a superior means from keeping water from entering the boat. Additionally, the above mentioned items are comfortable, convenient to use, attractive, have superior performance in a variety &water conditions, and are safe in the event of the necessity of escape because they are designed to release quickly and easily without failure. This invention will also provide the above mentioned items which can be manufactured faster and less costly than the prior art.

While my above description contains many specificities, these should not be construed as limitations on the scope of the invention, but rather as an exemplification of one preferred embodiment thereof. Many other variations are possible. For example, the coaming seal could be made of various other elastomers or have thicker or thinner sections, various shaped cross sectional ends, different sized or shaped ribs (or no ribs), or be cast separately and bonded to the cockpit cover fabric. Or the coaming seal may be replaced with my claimed reclosable profile seal to attache the spray skirt to the kayak cockpit. The dry top can also be made with long sleeves and standard wrist seals. The standard neck seal can be replaced with one which is adjustable. The dry top suspenders can be elastic and be attached in various configurations and at different attachment points. The P.F.D. sections can be made in a variety of shapes and configurations. The inside of the P.F.D. can have a moisture wicking liner, and part of the Gore Tex® (a registered trade mark of W. L. Gore and Associates, Inc.) material in the third embodiment can be replaced by other materials such as coated nylon or neoprene. The reclosable profile can be utilized to attach a variety of material such as mating dry bottoms to the dry tops, or to mate other waterproof sheeting materials, such as tarps. A waterproof zipper, waterproof velcro, or other reclosable and generally waterproof fastener can be utilized as the releasable fastener. The profile seal can have the female socket block extruded as a single extrusion with it's respective profile strip. A less expensive version of the standard configured spray skirt could be made by deleting the reclosable profile seal, and permanently attaching the waist band to the cockpit cover, and the waistband seal can be deleted. Thus, the scope of the invention should be determined not by the embodiments illustrated, but by the appended claims and their legal equivalents.

I claim:

1. A drytop for kayaking, said drytop is a substantially water proof garment for fitting about a boater's torso, a kayak cockpit cover, and a releasable profile fastener for attaching said drytop to said kayak cockpit cover so that the said drytop can be quickly and easily detached from said cockpit cover by the boater, said releasable profile fastener further comprising:

A first profile strip attached about the bottom of said drytop for attaching to a second profile strip attached about the opening of said kayak cockpit cover; and a release handle attached to said first profile strip to facilitate quick removal of said drytop from said cockpit cover by the boater.

2. The drytop of claim 1, further comprising:

an adjustable elastic waistband attached to an inside surface of said drytop for fitting around the waist of said boater so as to seal the bottom of said drytop to the boater;

a set of adjustable suspenders attached to said inside surface of said drytop wherein said suspenders will rest over the boater's shoulders and support said drytop;

an adjustable elastic cuff seal attached about each arm opening of the arm portions of said drytop for fitting about the arms of the boater; and a neck seal attached about an opening in the top of said drytop for fitting about the neck of the boater, such that the drytop is for use in cold water.

3. A waterproof reclosable profile seal for attaching generally waterproof sheet materials end to end, wherein said profile seal is flexible and further comprises:

first and second profile strips, each strip having a profile side, and a base side for attaching along an end of the sheet material, said profile sides each having a set of generally hook shaped members in cross-section, whereby said profile side of said first profile strip mates and interlocks with said profile side of said second profile strip wherein said first profile strip has male members which mate to female sockets in said second profile strip, said male members separate said hook members on said first profile strip and said female sockets separate said hook members on said second profile strip to seal and stabilize the said profile strips when mated together; and a locking device wherein said hook members of said first profile strip define locking cavities therewith adapted to respectively receive said interlockable hook members of said second profile strip therein whose tips or distal ends interlock by interfitting with and beneath the corresponding tips of said hook members of said first profile strip, and said hook members on each of said profile strips are oriented in the stone direction to withstand substantial unidirectional lateral shear of said interlocked first and second profile strips in a direction perpendicular to the length of said profile seal and in the direction said distal ends of said hook members face on their respective profile strips.

* * * * *